US010288376B2

(12) United States Patent
Gottzmann et al.

(10) Patent No.: US 10,288,376 B2
(45) Date of Patent: May 14, 2019

(54) RAIL SEGMENT FOR HANDGUARD OF A FIREARM AND ASSEMBLY THEREOF

(71) Applicant: Troy Industries, Inc., West Springfield, MA (US)

(72) Inventors: Alexander M. Gottzmann, Longmeadow, MA (US); Gary R. Morin, Hardwick, MA (US); Stephen P. Troy, Jr., West Springfield, MA (US)

(73) Assignee: TROY INDUSTRIES, INC., West Springfield, MA (US)

( * ) Notice: Subject to any disclaimer, the term of this patent is extended or adjusted under 35 U.S.C. 154(b) by 0 days.

(21) Appl. No.: 15/639,690

(22) Filed: Jun. 30, 2017

(65) Prior Publication Data

US 2018/0058808 A1 Mar. 1, 2018

Related U.S. Application Data

(63) Continuation of application No. 15/093,419, filed on Apr. 7, 2016, now Pat. No. 9,696,112.

(60) Provisional application No. 62/144,046, filed on Apr. 7, 2015.

(51) Int. Cl.
*F41C 23/16* (2006.01)
*F41G 11/00* (2006.01)

(52) U.S. Cl.
CPC ..... *F41C 23/16* (2013.01); *F41G 11/003* (2013.01)

(58) Field of Classification Search
CPC ..... F41C 23/16; F41G 11/003; F41G 11/004
USPC ..... 42/71.01
See application file for complete search history.

(56) References Cited

U.S. PATENT DOCUMENTS

| | | | | |
|---|---|---|---|---|
| 9,429,388 | B2 * | 8/2016 | Mayberry | F41C 23/16 |
| 9,441,905 | B2 * | 9/2016 | Hines | F41C 23/16 |
| 9,581,412 | B2 * | 2/2017 | Cheng | F41G 11/005 |
| 9,766,035 | B2 * | 9/2017 | Storch | F41C 23/16 |
| 9,777,985 | B2 * | 10/2017 | Roberts | F41G 11/001 |
| 9,921,029 | B2 * | 3/2018 | Roberts | F41C 27/00 |
| 9,964,380 | B1 * | 5/2018 | Oglesby | F41C 27/00 |
| 9,976,832 | B2 * | 5/2018 | Mayberry | F41C 27/00 |
| 2015/0219422 | A1 * | 8/2015 | Kincel | F41G 11/003 29/525.11 |
| 2016/0010946 | A1 * | 1/2016 | Gibbens | F41C 23/16 42/71.01 |
| 2017/0370675 | A1 * | 12/2017 | Storch | F41G 11/001 |
| 2018/0112952 | A1 * | 4/2018 | Kincel | F41G 11/004 |

(Continued)

*Primary Examiner* — Samir Abdosh
(74) *Attorney, Agent, or Firm* — Grossman, Tucker, Perreault & Pfleger, PLLC

(57) ABSTRACT

A handguard assembly for a firearm is provided, comprising a handguard configured to overlie a barrel of the firearm in spaced relationship, the handguard comprising a plurality of apertures; a rail segment including a plurality of mounting bosses, each of the plurality of mounting bosses located in a different one of the plurality of apertures of the handguard; a plurality of rotatable fasteners to fasten the rail segment to the handguard, each of the rotatable fasteners located in a different one of the mounting bosses of the rail segment; and each of the rotatable fasteners comprising a mounting latch to mount the rail segment to the handguard, each mounting latch rotatable from an aperture insertion position overlying a top of the boss to a mounting position overlying the handguard.

17 Claims, 10 Drawing Sheets

(56) References Cited

U.S. PATENT DOCUMENTS

2018/0135938 A1* 5/2018 Jen ..... F41C 23/16

* cited by examiner

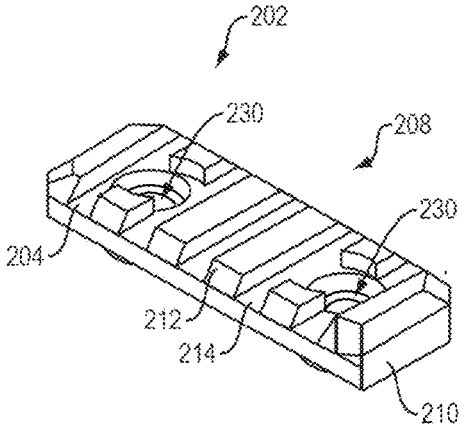
FIG. 8
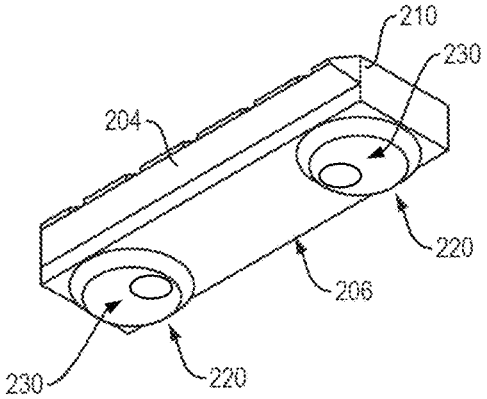
FIG. 9
FIG. 10
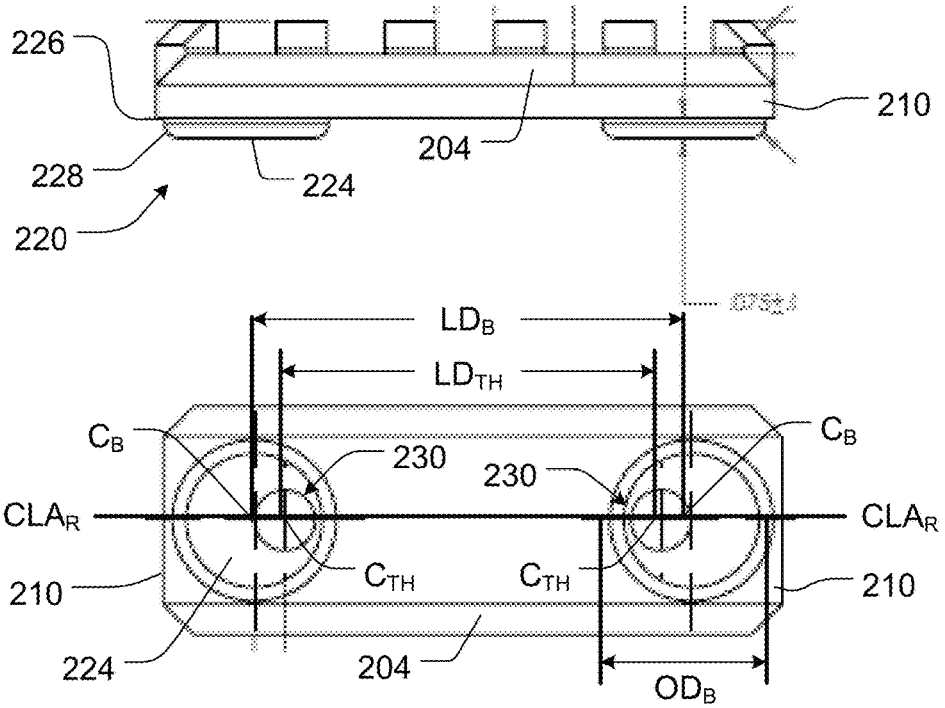
FIG. 11

RAIL SEGMENT FOR HANDGUARD OF A FIREARM AND ASSEMBLY THEREOF

CROSS-REFERENCE TO RELATED APPLICATIONS

This application is a continuation application of U.S. patent application Ser. No. 15/093,419 filed Apr. 7, 2016, which claims the benefit of U.S. provisional application No. 62/144,046 filed Apr. 7, 2015, which is incorporated by reference in its entirety.

FIELD

The present disclosure relates to relates to firearms, and more particularly relates to a handguard and rail for a firearm.

BACKGROUND

Certain firearms, such as certain semi-automatic and automatic firearms in the family of AR-15/M16 firearms, may include a tubular handguard which surrounds at least a portion of the length of the barrel.

Among other functions, the handguard may protect the firearm operator's hand from a heated barrel after the firearm is fired, particularly by inhibiting the operator's hand from contacting the barrel directly and subsequently suffering a burn or other injury. The handguard may also protect the barrel and other parts of the firearm contained therein from being damaged during use of the firearm.

The handguard may be adapted to receive a rail segment, which is attachable thereto, particularly with mechanical fasteners. However, attachment of the rail segment to the handguard with the fasteners may be cumbersome, and/or the mechanical fasteners may loosen with use, which may cause the mechanical fasteners and/or the rail segment to undesirably detach from the handguard.

What is needed is a rail segment attached with fasteners which addresses the aforementioned limitations in the art.

SUMMARY

The present disclosure provides rail segments which may be fastened to a handguard with fasteners in such a way that attachment of the rail segment to the handguard is less cumbersome, as well as inhibits loosening of the rail segment from the handguard.

In at least one embodiment, the present disclosure provides a rail segment assembly for a firearm comprising a handguard configured to overlie a barrel of the firearm in spaced relationship, the handguard comprising a plurality of apertures; a rail segment including a plurality of mounting bosses, each of the plurality of mounting bosses configured to be located in a different one of a plurality of apertures of a handguard; a plurality of rotatable fasteners to fasten the rail segment to the handguard with each of the rotatable fasteners located in a different one of the mounting bosses of the rail segment; and each of the rotatable fasteners comprising a mounting latch to mount the rail segment to the handguard, each mounting latch rotatable from an aperture insertion position overlying a top of the boss to a mounting position overlying the handguard.

In at least one embodiment, the present disclosure also provides a handguard assembly for a firearm comprising a handguard configured to overlie a barrel of the firearm in spaced relationship, the handguard comprising a plurality of apertures; a rail segment including a plurality of mounting bosses, each of the plurality of mounting bosses located in a different one of the plurality of apertures of the handguard; a plurality of rotatable fasteners to fasten the rail segment to the handguard, each of the rotatable fasteners located in a different one of the mounting bosses of the rail segment; and each of the rotatable fasteners comprising a mounting latch to mount the rail segment to the handguard, each mounting latch rotatable from an aperture insertion position overlying a top of the boss to a mounting position overlying the handguard.

In at least one embodiment, the present disclosure also provides method of attaching a rail segment to a handguard for a firearm comprising providing a handguard configured to overlie a barrel of the firearm in spaced relationship, the handguard comprising a plurality of apertures; providing a rail assembly, the rail assembly comprising a rail segment and a plurality of rotatable fasteners to fasten the rail segment to the handguard, wherein the rail segment includes a plurality of mounting bosses, wherein each of the rotatable fasteners is located in a different one of the mounting bosses of the rail segment, and wherein each of the rotatable fastener comprises a first fastener member connected to a second fastener member; positioning each of the second fastener members in an aperture insertion position in which a latch of each second fastener member overlies a top of the mounting boss in which the rotatable fastener is located; inserting each of the plurality of mounting bosses in a different one of the plurality of apertures of the handguard; positioning each of the second fastener members in a mounting position in which the latch of each second fastener member overlies the handguard; and rotating each of the first fastener members to tighten the latch of each second fastener member against the handguard.

FIGURES

The features of this disclosure, and the manner of attaining them, will become more apparent and better understood by reference to the following description of embodiments described herein taken in conjunction with the accompanying drawings, wherein:

FIG. 8 is a first perspective view of a rail segment of the rail assembly of FIG. 7;

FIG. 9 is a second perspective view of the rail segment of the rail assembly of FIG. 7;

FIG. 10 is a side view of the rail segment of the rail assembly of FIG. 7;

FIG. 11 is a bottom plan view of the rail segment of the rail assembly of FIG. 7;

DETAILED DESCRIPTION

Figure 1:
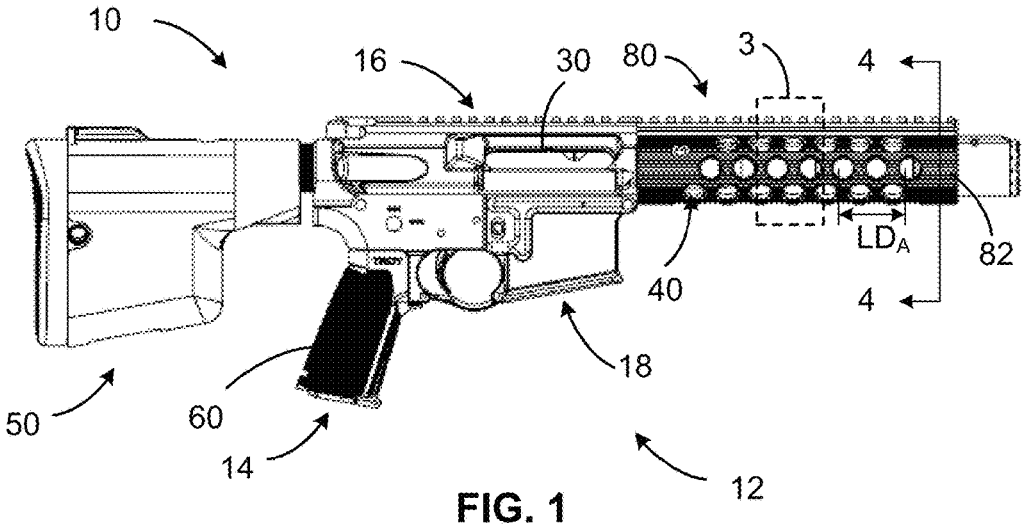
FIG. 1 is a side view of a firearm according to the present disclosure.

It may be appreciated that the present disclosure is not limited in its application to the details of construction and the arrangement of components set forth in the following description or illustrated in the drawings. The invention(s) herein may be capable of other embodiments and of being practiced or being carried out in various ways. Also, it may be appreciated that the phraseology and terminology used herein is for the purpose of description and should not be regarded as limiting as such may be understood by one of skill in the art.

Figure 2:
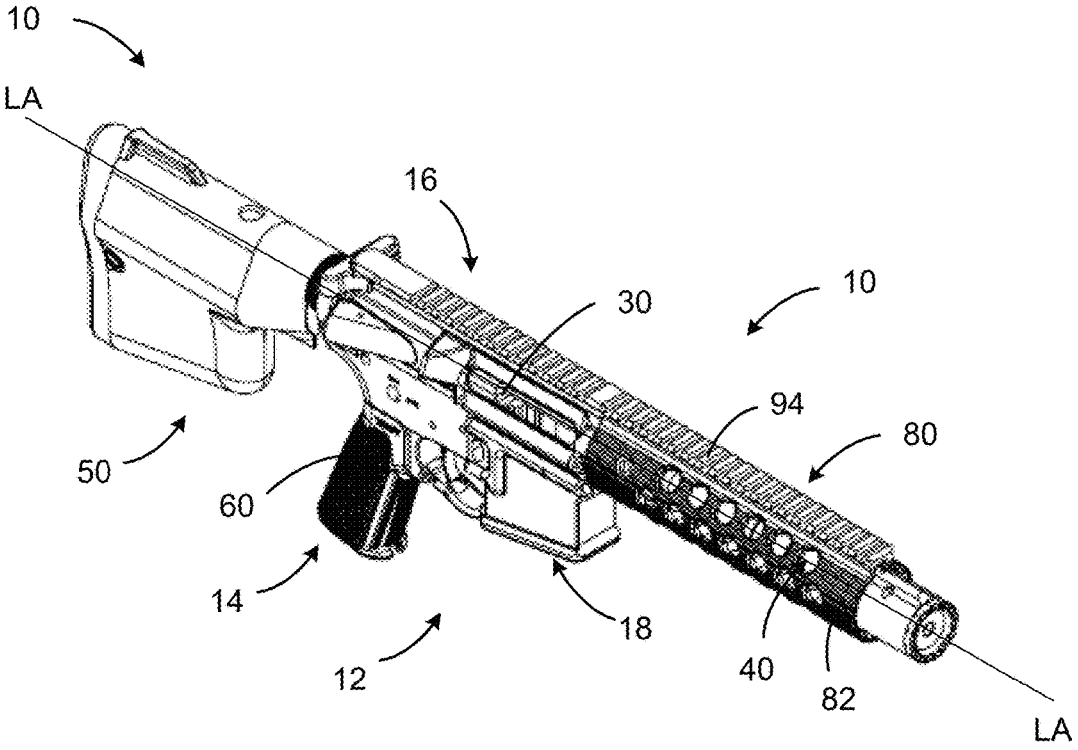
FIG. 2 is a front perspective view of the firearm of FIG. 1.

Referring now to FIGS. 1-2, there is shown a firearm 10 according to the present disclosure. As shown, the firearm 10 may comprise a gas-operated semi-automatic or full-automatic firearm. The gas operated system may be a direct gas impingement system, or a gas operated piston system. The direct gas impingement system directs hot propellant combustion gas from a fired cartridge directly to a bolt carrier to cycle the action of the firearm. More particularly, the gas pressure of the combustion gas pushes the bolt carrier rearward against the bias of a buffer spring, during which time the fired cartridge case is extracted from the chamber of the barrel and ejected from the firearm. As the gas pressure dissipates, the compressed buffer spring then decompresses and pushes the bolt carrier forward, during which time an unfired cartridge is removed from the magazine and loaded into the chamber of the barrel. In contrast to a direct gas impingement system, with a gas operated piston system, the gas forces a piston rod of a piston and the bolt carrier rearward to handle the extraction and ejection process, and thereafter the bolt carrier is forced forward by a decompression of the buffer spring to the closed position just as with direct impingement.

Even more particularly, firearm 10 may be a member of the family of AR-15/M16 firearms, which may include the AR-10, AR-15, M16, M16A1, M16A2, M16A3, M16A4, M4, M4A1, CAR-15, etc. Firearm 10 may also include a submachine gun, a compact assault rifle or a machine pistol. Firearm 10 may be configured to fire rifle cartridges (e.g. the 5.56×45 mm NATO military cartridge, 5.56/.223 Remington, 300 Blackout, .308 Win/7.62×51, 5.45×39, 7.62×39, 458 SOCOM, and .50 Beowulf) as well as pistol cartridges (9 mm). Firearm 10 may be categorized as a rifle, a carbine, a mid-length or a pistol, particularly depending on barrel length.

As shown, firearm 10 includes a receiver 12 comprising a lower receiver 14 and mating upper receiver 16. Upper receiver 16 includes bolt carrier 30 including a firing pin, as well as a cartridge loading and unloading mechanism. A barrel 40 is affixed to the front end of upper receiver 16 and a butt stock 50 is affixed to the rear end of lower receiver 14. A trigger portion of upper receiver 16 fits into an access opening in lower receiver 14 and is integrated with the internal mechanism of upper receiver 16 and lower receiver 14. A pistol grip 60 is attached to lower receiver 14. A detachable (removable) box magazine as known in the art (not shown) may be inserted into a magazine receptacle 18 having a downwardly oriented access opening in lower receiver 14 for feeding cartridges to the cartridge insertion and ejection mechanism within upper receiver 16. The detachable magazine is capable of being loaded and unloaded while detached from firearm 10, and holds the cartridges side-by-side in one or more columns/rows, which may be staggered. In certain embodiments, the detachable magazine may also comprise a drum magazine in which the cartridges are positioned and fed in an unwinding spiral.

Figure 3:
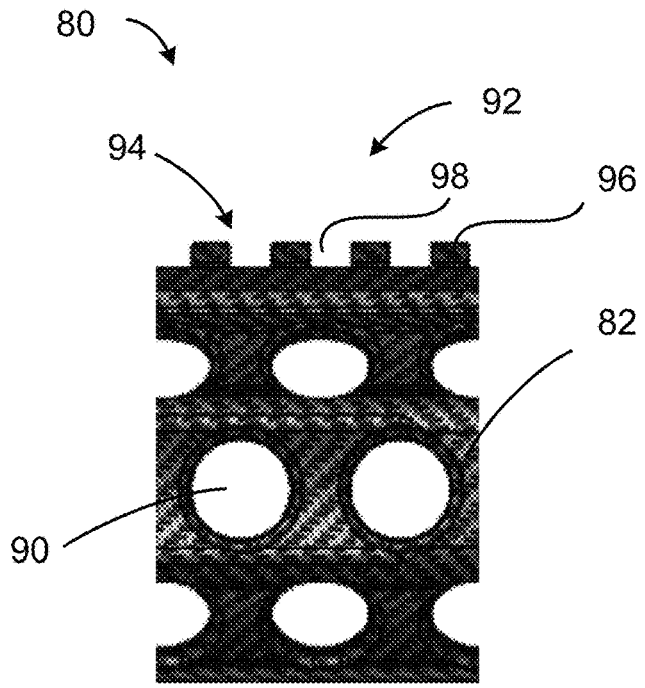
FIG. 3 is an enlarged side view of the portion of the handguard of the firearm of FIG. 1 bounded by rectangle 3.

A handguard 80 is affixed at the front end of upper receiver 16, either to the upper receiver 16 or the barrel 40. Handguard 80 includes an elongated tubular body 82. FIG. 3 shows an enlarged view of the portion of tubular body 82 bounded by the area of circle 3 of FIG. 1, while FIG. 4 shows a cross section of the tubular body 82 taken along line 4-4 of FIG. 1.

Figure 4:
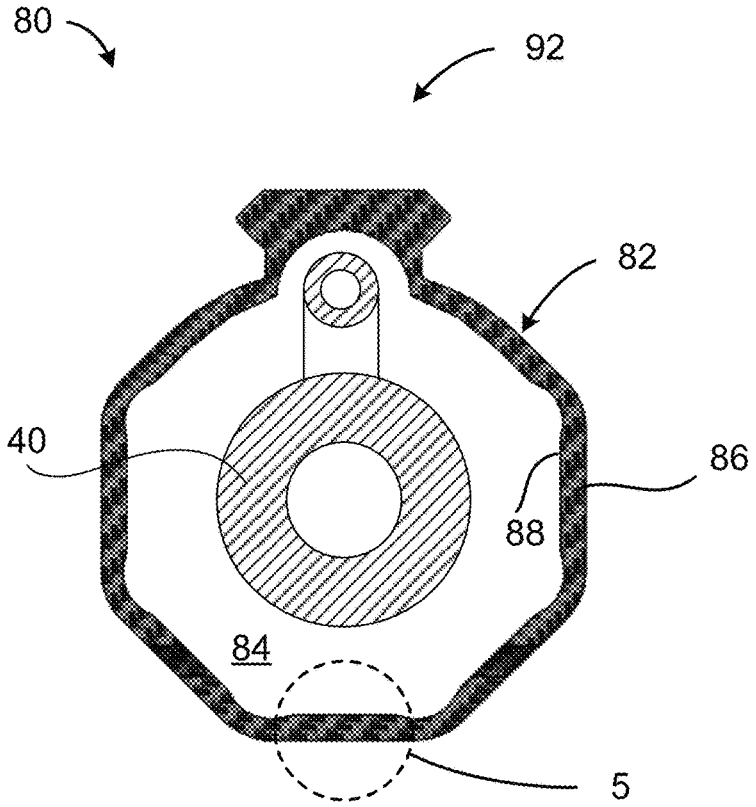
FIG. 4 is a cross-sectional side view of the handguard of the firearm of FIG. 1 taken along line 4-4 of FIG. 1.

As shown by FIG. 4, the tubular body 82 may have a substantially octagonal (i.e. having 8 sides) shaped cross-section. It will of course be understood that the cross-sectional profile could be oval, square, rectangular, or any cylindrical configuration which is hollow so as to surround at least a portion of the barrel 40 of firearm 10 without coming in contact therewith along the length of the barrel 40 that is surrounded. The length of tubular body 82 of handguard 80 may particularly be such that, when mounted on firearm 10, it extends from the front surface of the upper receiver 16 of the firearm 10 to a distance short of the end of the barrel 30 for easy and convenient gripping by the firearm operator and for protection of the operator's hand from the barrel 40. Handguard 80, and more particularly the tubular body 82, may also serve as a platform to mount accessories to the fore-end of the firearm 10, such as by providing one or more accessory mounting rails as discussed herein. As shown, the tubular body 82 of the handguard 80 may be provided by as a single piece tubular member.

As shown, tubular body 82 defines an elongated center passage 84 to contain the barrel 40, as well as certain other components (e.g. the combustion gas return tube or other accessories/features that may be incorporated at some future time) depending on the type of firearm 10. Tubular body 82 has an outer surface 86 and an inner surface 88, and may include a plurality of rows of apertures 90 formed therein, particularly to vent heat away from the barrel 40. While the apertures 90 are shown as having a circular shape, the apertures 90 may have any geometric shape including oval, ellipse, triangle, square, rhombus, diamond, rectangle, pentagon, hexagon, heptagon, octagon, etc. The apertures 90 may be formed in the tubular body 82 after the handguard 80 is molded as discussed in greater detail below.

The top side 92 of the handguard 80, and the tubular body 82, may include an elongated accessory (mounting) rail 94, which provides a mounting platform for accessories (e.g.

scope). As shown by FIG. 4, elongated rail 94 has a T-shaped cross-sectional profile (transverse to the longitudinal axis LA of the handguard 80). Elongated rail 94 may more particularly be a Weaver rail or a Picatinny rail, comprising a plurality of alternating equally spaced parallel ribs 96 and slots 98 extending transverse to the longitudinal axis LA of the handguard 80.

Figure 5:
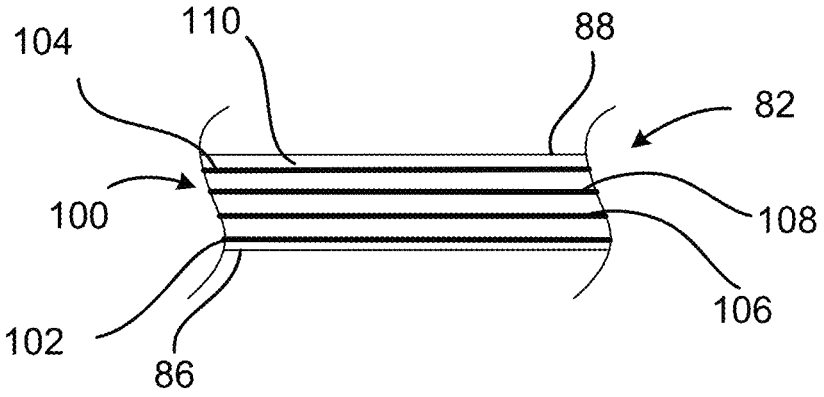
FIG. 5 is an enlarged cross-sectional view of the portion of the handguard of FIG. 4 bounded by circle 5.

Referring now to FIG. 5, handguard 80, and more particularly tubular body 82, may be formed of a composite material comprising a plurality of constituent components. More particularly, the composite material may be a fiber reinforced plastic composite material, in which a reinforcement structure 100 in fiber form is embedded in a matrix (binder) composition 110 which comprises at least of polymer. The reinforcement structure 100 may also be referred to as the discontinuous phase while the matrix composition 110 may be referred to as the continuous phase. The composite material of the present disclosure may provide a handguard 80 formed of a thermal (non-conductive) insulator which provides high heat resistance, high impact strength and protects the operator's hand from the heat of the barrel 40, as well as inhibits the rail 94 as disclosed herein from heating, possibly adversely affecting the operation of any accessories mounted thereon.

The matrix composition 110 may be a thermoset matrix composition formed of at least one thermoset polymer. Exemplary thermoset polymers may include polyester, epoxy, vinyl ester, methyl methacrylate and phenolic.

The reinforcement structure 100 may particularly comprise at least one reinforcement layer 102, which is embedded in the matrix composition 110. More particularly, the at least one reinforcement layer 102 may comprise a plurality of reinforcement layers 102, 104, 106 and 108. As shown by FIG. 5, reinforcement layer 102 is shown to be an outer reinforcement layer, reinforcement layer 104 is shown to be an inner reinforcement layer and reinforcement layers 106, 108 are shown to be intermediate reinforcement layers between outer reinforcement layer 102 and inner reinforcement layer 104.

Any one or all of the reinforcement layers 102, 104, 106 and 108 may be provided by a tubular reinforcement member, which is particularly provided without a terminating edge or a seam extending in the longitudinal direction of the tubular reinforcement member (which may be understood to be in the same as the longitudinal axis LA of the handguard 80). More particularly, any one or all of the reinforcement layers 102, 104, 106 and 108 may be provided by a tubular braided and/or woven fabric sleeve. For example, any or all of the reinforcement layers 102, 104, 106 and 108 may comprise a braided fiber sleeve where the fibers (continuous) are arranged (woven) in a multi-directional (biaxial) braid such that the braided fiber bundles (braid yarns or strands) are arranged off-axis, i.e. at an angle of +/−45 degrees) relative to the longitudinal axis LA of the tubular sleeve. Stated another way, the fibers are not arranged parallel to a longitudinal axis LA of the tubular body 82. In such a manner, the fiber orientation may provide for balanced control of torsional and longitudinal loads placed on the handguard 80. Also, while the tubular braided sleeve may be manufactured with the fiber bundles at +/−45 degrees, the actual orientation in the molded tubular body 82 may be broader (due to stretching or other shaping of the tubular braided sleeve), such as within a range of +/−30 degrees to +/−60 degrees.

Any one or all of the reinforcement layers 102, 104, 106 and 108 may also comprise a woven fiber sleeve where the fibers (continuous) are arranged (woven) such that the fiber bundles (braid yarns or strands) are arranged multi-directionally, particularly longitudinally (0 degrees) and transversely (90 degrees), relative to the longitudinal axis LA of the tubular sleeve. Stated another way, the fibers are arranged parallel and perpendicular to a longitudinal axis LA of the tubular body 82.

Any one or all of the reinforcement layers 102, 104, 106 and 108 may be made of glass fibers, carbon fibers or a combination thereof. In a particular embodiment, reinforcement layers 104, 106 and 108 may be made of carbon fiber, while reinforcement layer 102 is made of glass fiber. In another embodiment, reinforcement layers 102, 104 and 108 may be made of carbon fiber, while reinforcement layer 106 made of glass fiber. The weight/area and the diameter of the layers 102, 104, 106, 108 may vary depending on the particular application of the handguard 80 and the type of firearm 10.

With regards to fiber loading, the tubular body 82, may have a fiber content in a range of 30% to 60% by weight of the tubular body 82, and more particularly have a fiber content in a range of 35% to 55% by weight of the tubular body 82. The fibers may comprise 80-95% by weight carbon fibers and 5%-20% by weight glass fibers. The tubular body may have a thickness in a range of 0.5 mm to 10 mm, and more particularly have a thickness in a range of 2 mm to 5 mm.

The handguard 80, and more particularly the tubular body 82, may be formed by a closed mold (i.e. two-sided) molding process, such as resin infusion molding process where the matrix composition (e.g. polymer resin) is introduced into a mold containing the preplaced/preloaded reinforcement structure 100. More particularly, the resin infusion molding process may be a resin transfer molding process, which may be vacuum (i.e. less than atmospheric pressure) or pressure (i.e. greater than atmospheric pressure) assisted, to obtain a tubular body 82 with low void content and high fiber loading.

As part of the process, a mold may be provided which has at least one molding cavity to form the tubular body 82, with the molding cavity being defined by opposing mold halves which may be referred to as the core half and cavity half. The molding process may begin by opening the mold and placing the inner reinforcement layer 104 over an elongated core half of a mold, which may be referred to as the mandrel. The intermediate layer 108 may then be placed over the inner layer 104, followed by intermediate layer 106 and the outer layer 102 placed over the intermediate layer 106 to form a four layer reinforcement structure 100. The mold may then be closed and clamped.

In alternative embodiments the reinforcement layers 102, 104, 106 and 108 may be formed to a preformed shape of the tubular body 82 before being placed in the mold, such as being formed over a performing mandrel and then sprayed with a stiffening agent such as starch. The reinforcement layers 102, 104, 106 and 108 may then all be introduced to the molding cavity simultaneously.

The matrix composition 110 may then introduced into the molding cavity (e.g. pumped in under pressure greater than gravity), such as while in the form of a catalyzed low viscosity polymer resin. The matrix composition 110 flows through the molding cavity and the interstices of the reinforcement layers 102, 104, 106 and 108 while displacing air from the molding cavity. Air may be displaced from the molding cavity through one or more molding cavity vents formed in the mold, or a vacuum may be drawn on the molding cavity to remove air from the molding cavity as well as assist helping the matrix composition 110 flow through the molding cavity and reinforcement layers 102, 104, 106 and 108 located therein.

After the matrix composition 110 has filled the mold and undergone a suitable cure time, the mold may be opened and the handguard 80 comprising the tubular body 82 removed from the mold. The tubular body 82 may then be trimmed and apertures 90 formed (cut) therein. Alternatively the apertures 90 may be formed therein during molding.

As an alternative to resin transfer molding, other resin infusion molding processes which may be used to manufacture the handguard 80 of the present disclosure may include structural reaction injection molding, which may particularly make use of a thermoset polymer such as a polyurethane which is processed through a reaction injection molding mixhead.

Another closed mold (i.e. two-sided) molding process which may be used to produce handguard 80, particularly tubular body 82, may be compression prepreg process in which a reinforcement structure is saturated with a matrix composition 110 (a/k/a pre-impregnation), which is then compression molded with heat and pressure to form the molded article.

In the foregoing embodiment of the handguard 80, the ribs 96 and slots 98 forming the elongated rail 94 may be formed in the tubular body 82 during molding. Alternatively, the ribs 96 and slots 98 may be formed after molding the tubular body 82 by milling, or otherwise cutting, the slots 98 into the tubular body 82, thereby forming the ribs there between.

Figure 6:
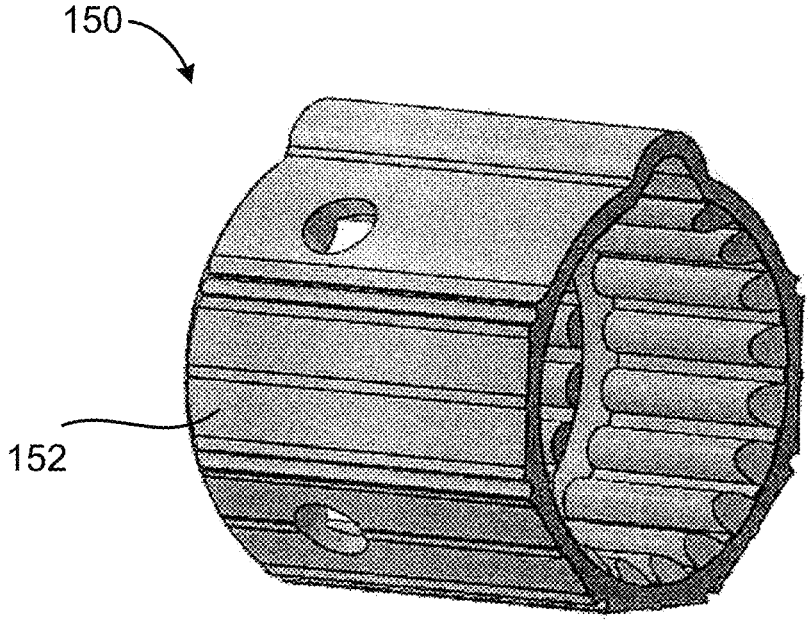
FIG. 6 is a perspective view of an attachment member which may be provided with a handguard according to the present disclosure to attach the handguard to the firearm.

In another embodiment of the handguard 80 of the present disclosure, as shown in FIG. 6, the handguard 80 may include attachment member 150 configured to attached the handguard 80 to the upper receiver 16 or the barrel 40 of firearm 10. The attachment member 150 may be formed of metal (e.g. aluminum, steel, titanium), or a plastic (e.g. a thermoset composite as disclosed herein, or injection molded from a thermoplastic composition). The attachment member 150 and the handguard 80 may attach to the upper receiver 16 or barrel 40 of firearm 10 in a manner as disclosed in U.S. Pat. No. 8,037,633 entitled "Handguard System For Firearms" and U.S. Pat. No. 8,464,457 entitled "Firearm Handguard System", both assigned to the assignee of the present disclosure and both hereby incorporated by reference in their entirety.

As shown, attachment member 150 may have an outer profile 152 which substantially conforms to the inner profile 89 of the tubular body 82. The attachment member 150 may be coupled to the handguard 80 by being located within the elongated center passage 84 and interference (press-fit) against tubular body 82. Alternatively, the outer profile 152 of the attachment member 150 and/or the inner profile 89 of the tubular body 82 may be coated with a bonding agent to form an adhesive bond therebetween. Alternatively, adhesive bonding the attachment member 150 to the tubular body 82 of the handguard 80 may be accomplished using the matrix composition 110.

Such may be accomplished by placing the attachment member 150 in the forming mold for the tubular body 82, such as by positioning the upper elongated rail segment on the core half of the mold, prior to introducing the matrix composition 110. Thereafter, when the matrix composition 110 is introduced into the molding cavity and the tubular body 82 is formed, the attachment member 150 becomes a molded-in insert during molding of the tubular body 82 which is bonded directly to the matrix composition 110 during molding. Alternatively, adhesive bonding the attachment member 150 to the tubular body 82 of the handguard 80 may be accomplished using the matrix composition 110 as a coating which is applied to the tubular body 82 after molding, which may be brushed on. The attachment member 150 may then be placed in overlying relationship to the coating had held with pressure thereto until the matrix composition 110 has suitably cured.

Referring now to FIGS. 7-19, in other embodiments of the present disclosure, the handguard 80 may also include at least one rail segment assembly 200 comprising a separately formed rail segment 202 which may be mechanically attached to the tubular body 82. Rail segment 202 may more particularly be a Weaver rail or a Picatinny rail segment which is attachable and removable from the handguard 80.

As best shown in FIGS. 7-11, rail segment 202 comprises an elongated rail segment body 204. Rail segment body 204 has a center longitudinal axis $CLA_R$, which extends longitudinally with the length of the rail segment body 204. The center longitudinal axis $CLA_R$ may be understood as the longitudinal axis which longitudinally bisects the rail segment body 204. The rail segment body 204 may have a T-shaped cross-sectional profile transverse to the center longitudinal axis $CLA_R$ of the rail segment body 204.

An upper (outer) surface 208 of the rail segment body 204 may comprise a plurality of alternating equally spaced parallel ribs 212 and slots 214 extending along an axis laterally transverse to the center longitudinal axis $CLA_R$ of the rail segment body 204.

A lower (mounting) surface 206 of the rail segment body 204 may include at least two (circular) mounting bosses 220, spaced adjacent the opposing longitudinal ends 210 of the rail segment body 204, which provide protrusions which protrude from base surface 216. As shown, the center $C_B$ of each boss 220 is located on the center longitudinal axis $CLA_R$ of the rail segment body 204, with the height (length) of each boss 220 extending along a mounting axis which is vertically transverse to the center longitudinal axis $CLA_R$ of the rail segment body 204.

The mounting bosses 220 are configured be located within apertures 90 of handguard 80. As such, to provide a proper fit to the handguard 80, the center-to-center longitudinal distance between the bosses $LD_B$ along the center longitudinal axis $CLA_R$ of the rail segment body 204 should be understood to be substantially equal the center-to-center longitudinal distance between the apertures $LD_A$ (see FIG. 1) along the longitudinal axis of the handguard 80 (e.g. equal to within a distance of 0.04 inch, and more particularly 0.02 inch). Stated another way, the difference between the center-to-center longitudinal distance $LD_B$ of the bosses 220 and the center-to-center longitudinal distance $LD_A$ of the apertures 90 should be 0.04 inch or less, and more particularly 0.02 inch or less.

Moreover, the mounting bosses 220 should have a maximum outer diameter $OD_B$ substantially equal to the diameter of aperture 90. More particularly, the maximum outer diameter of each boss 220 may be in a range of 0.001 inch to 0.04 inch less than the diameter of aperture 90, and even more particularly the maximum outer diameter $OD_B$ of each boss 220 may be in a range of 0.001 inch to 0.02 inch less than the diameter of aperture 90.

In order to better lead each boss 220 into aperture 90, the transition from the top surface 224 to the side surface 226 of each boss 220 may rounded with a fillet 228, which may be formed at a radius. Moreover, the side surface 226 of each boss 220 may be tapered such that the boss 220 narrows towards top surface 224.

A mounting through-hole 230 formed with a counterbore extends through each end rail segment body 204, including each boss 220, adjacent the opposing longitudinal ends 210 of the rail segment body 204. Similar to the bosses 220, the center $C_{TH}$ of each through-hole 230 is located on the center longitudinal axis $CLA_R$ of the rail segment body 204, with the length of each through-hole 230 extending along an axis which is vertically transverse to the center longitudinal axis $CLA_R$ of the rail segment body 204.

As shown, the center-to-center longitudinal distance between the through-holes $LD_{TH}$ along the center longitudinal axis $CLA_R$ of the rail segment body 204 is less than the center-to-center longitudinal distance between the bosses $LD_B$ along the center longitudinal axis $CLA_R$ of the rail segment body 204. Stated another way, the center of each through-hole 230 does not extend through the center of each boss 220, but is offset laterally inward along the center longitudinal axis $CLA_R$ of the rail segment body 204 relative to the boss 220 through which the through-hole 230 extends.

Figure 7:
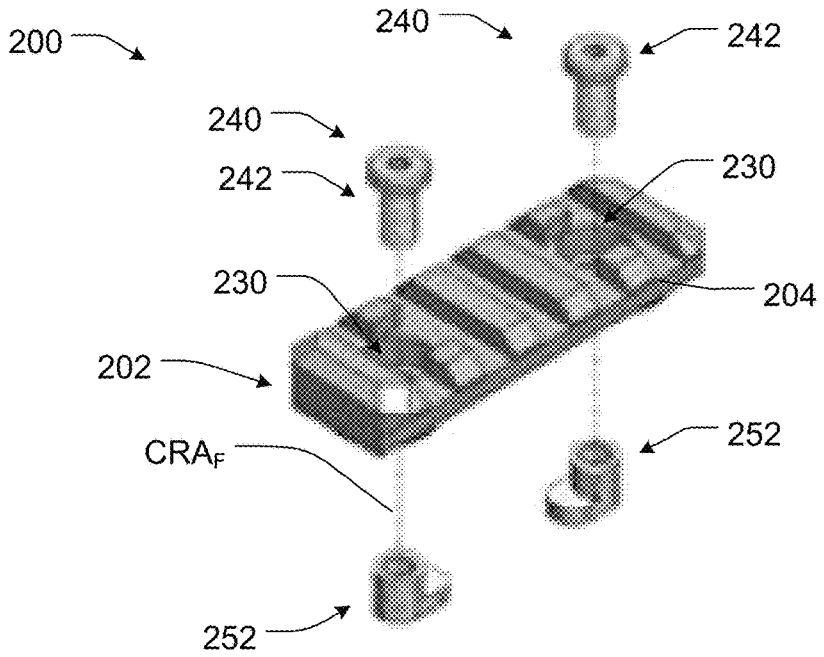
FIG. 7 is an exploded view of a rail assembly according to the present disclosure.

Referring now to FIG. 7, through-hole 230 is configured to receive a fastener 240 which comprises a first fastener member 242 and a second fastener member 252. First fastener member 242 and second fastener member 252 may be mechanically (e.g. threadably) connectable to one another as part of attaching the rail segment body 202 to the tubular body 82 and mechanically disconnectable from one another as part of detaching the rail segment body 202 from the tubular body 82.

As shown, first fastener member 242 may comprise an externally threaded male fastener 272, such as a socket head cap screw, while second fastener member 252 may be an internally threaded female fastener 252, such as a nut.

Figure 12:
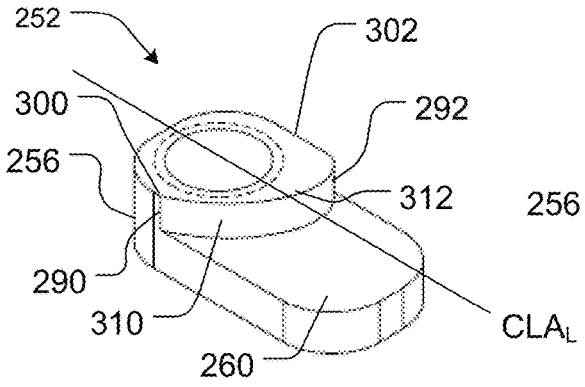
FIG. 12 is a first perspective view of a fastener member of the rail assembly of FIG. 7.
Figure 13:
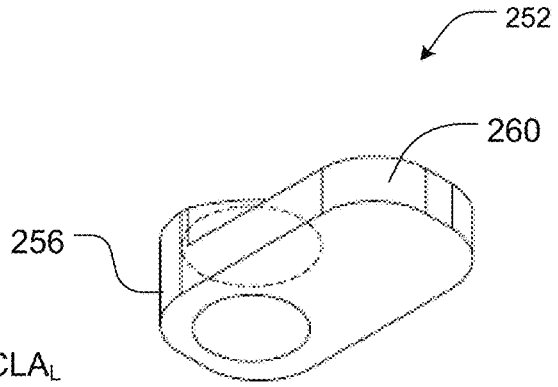
FIG. 13 is a second perspective view of the fastener member of the rail assembly of FIG. 7.

As best shown in FIGS. 12-13, second fastener member 252 may comprise an internally threaded (non-circular) pillar portion 256 and a clamping latch portion 260 extending transverse from the center rotational axis $CRA_F$ of the pillar portion 256 (see FIG. 7). It should be understood that the pillar portion 256 does not have a uniformly circular outer perimeter (i.e. it does not have a constant radius extending from a center rotational axis $CRA_F$) and hence, may be understood as non-circular.

Figure 14:
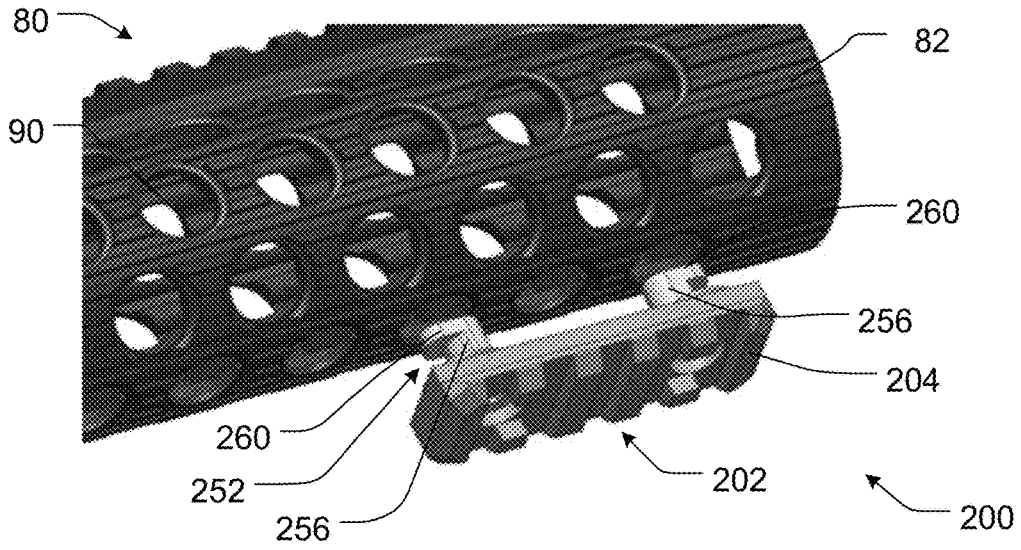
FIG. 14 is a perspective view of the rail assembly of FIG. 1 with first and second fasteners positioned in an installation position for installation on a handguard.
Figure 15:
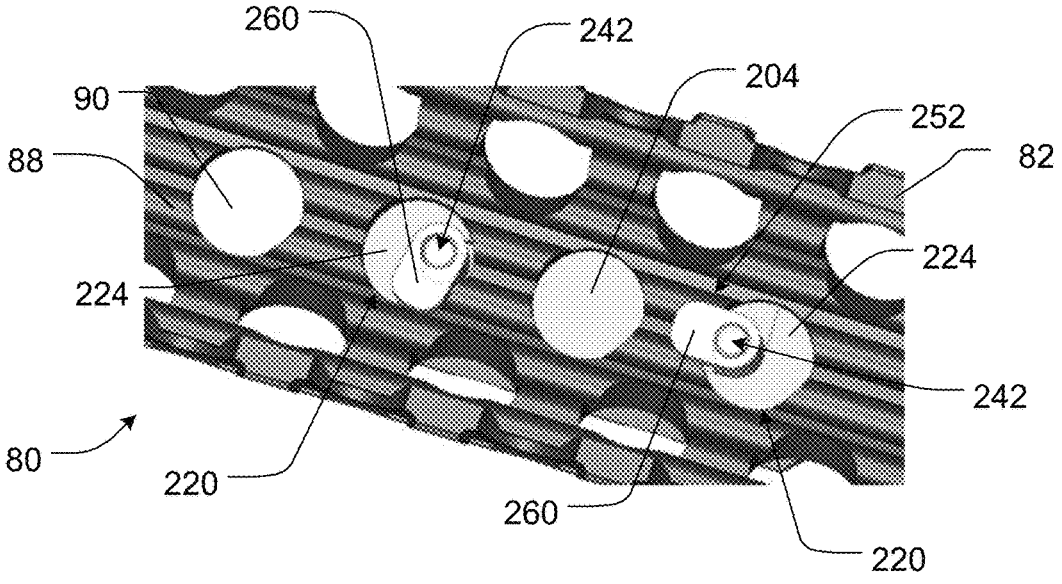
FIG. 15 is a perspective view of the rail assembly and handguard of FIG. 14 with one of the fasteners rotated to a mounting position with the handguard and the other fastener rotated half-way between the installation position and the mounting position.

As best shown in FIGS. 14-15, to attach the rail segment body 202 to the tubular body 82, the first fastener member 242 and the second fastener member 252 may be partially threaded together. As shown in FIG. 14, the latch portion 260 of each second fastener member 252 may then be positioned to face longitudinally outwards, particularly along the center longitudinal axis $CLA_R$ of the rail segment body 204 such that a center longitudinal axis $CLA_L$ of the latch portion 260 is substantially parallel (aligned) with the longitudinal axis $CLA_R$ of the rail segment body 204. When the latch portion 260 of each second fastener member 252 is positioned laterally outwards in such manner, the second fastener member 252, and more particularly the latch portion 260, is arranged in an aperture insertion position such that it completely overlies the top surface 224 of each boss 220. In the foregoing manner, when the center $C_B$ of each boss 220 is aligned with the center of each aperture 90, each boss 220 may be inserted along the center axis parallel straight into an aperture 90 of the tubular body 82 of the handguard 80 without the second fastener member 252 inadvertently contacting the wall of the aperture 90 or other portion of the tubular body while the each boss 220 is properly being seated in the aperture 90.

Figure 16:
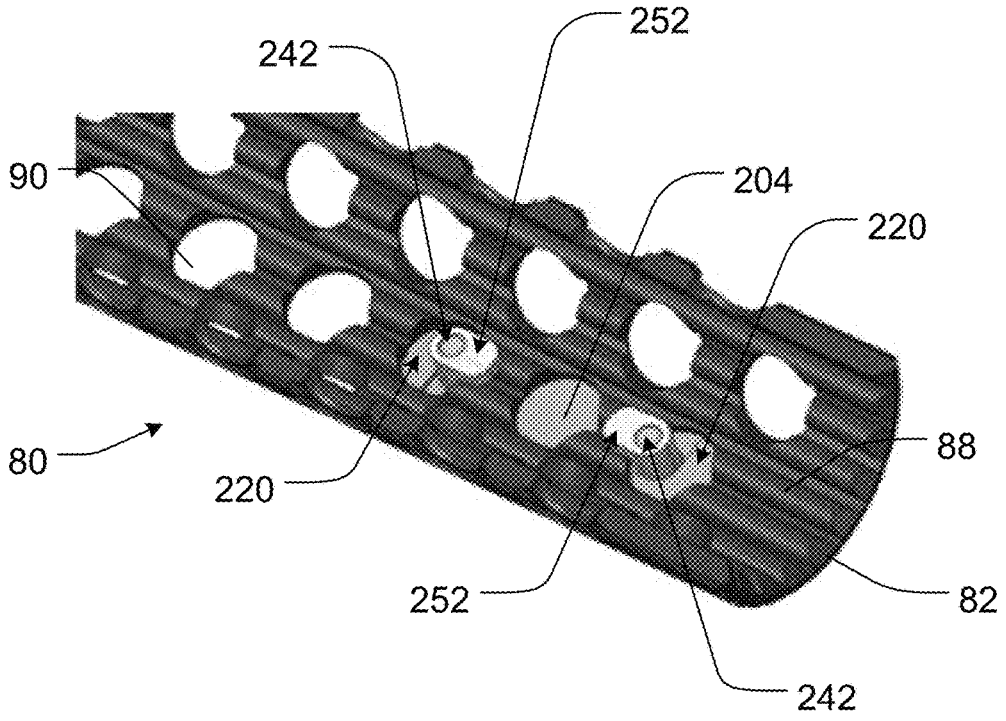
FIG. 16 is a perspective view of the rail assembly and handguard of FIG. 14 with both fasteners in the mounting position.
Figure 17:
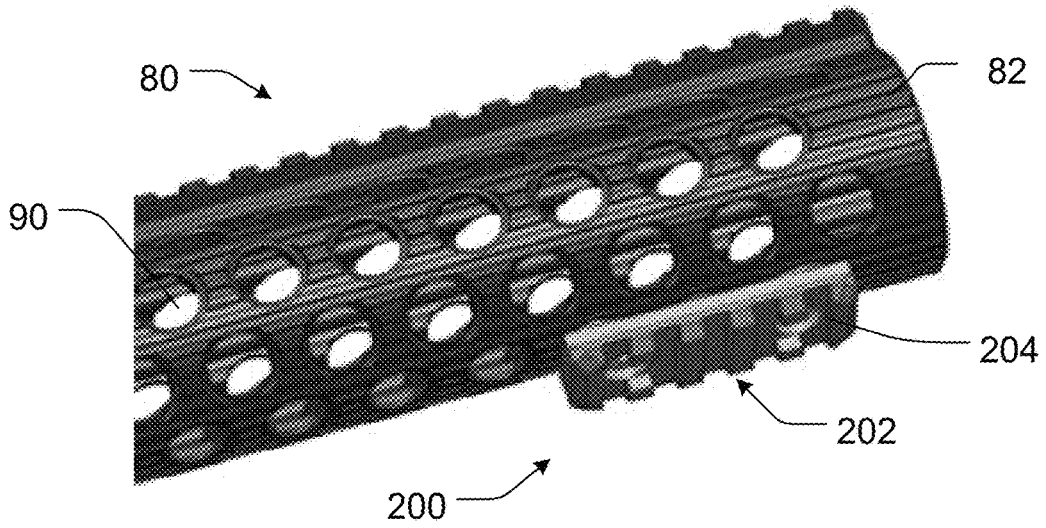
FIG. 17 is a perspective view of another embodiment of a rail section of the rail assembly of FIG. 7.

Thereafter, as shown in FIGS. 15-17, when each boss 220 is properly located in an aperture 90 of the tubular body 82, the latch portion 260 of each second fastener member 252 may be rotated 180 degrees (e.g. by direct rotation by hand or by rotation of the first fastener member 242) such that the latch portion 260 of each second fastener member 252 may be positioned to face longitudinally inwards, particularly along the center longitudinal axis $CLA_R$ of the rail segment body 204 such that a center longitudinal axis $CLA_L$ of the latch portion 260 is substantially coextensive with the longitudinal axis $CLA_R$ of the rail segment body 204. When the latch portion 260 of each second fastener member 252 is positioned laterally inwards in such manner, the second fastener member 252, and more particularly the latch portion 260, is arranged in a mounting (clamping) position such it now overlies the inner surface 88 of tubular body 82. Now, the first fastener member 272 maybe further threaded (rotated clockwise) into the second fastener member 252 such that the latch portion 260 of the second fastener member 252 bears down and tightens (clamps) against the inner surface 88 of the tubular body 82, such that the tubular body 82 is now clamped and secured between the rail segment body 204 and the latch portion 260 of the second fastener member 252. Thereafter, to remove the rail assembly 200 from the handguard 80, the first fastener member 272 maybe unthreaded (rotated counter-clockwise) from the second fastener member 252 such that the latch portion 260 of the second fastener member 252 loosens and separates from the inner surface 88 of the tubular body 82, and the latch portion 260 of the second fastener member 252 may be rotated from the mounting position back to the aperture insertion position.

Figure 18:
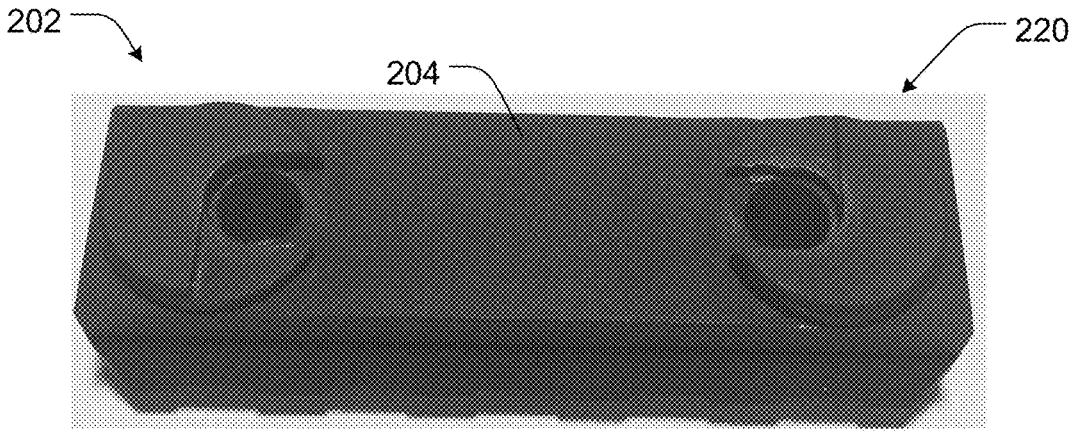
FIG. 18 is a close-up perspective view of the lower mounting surface of the rail section of FIG. 17.
Figure 19:
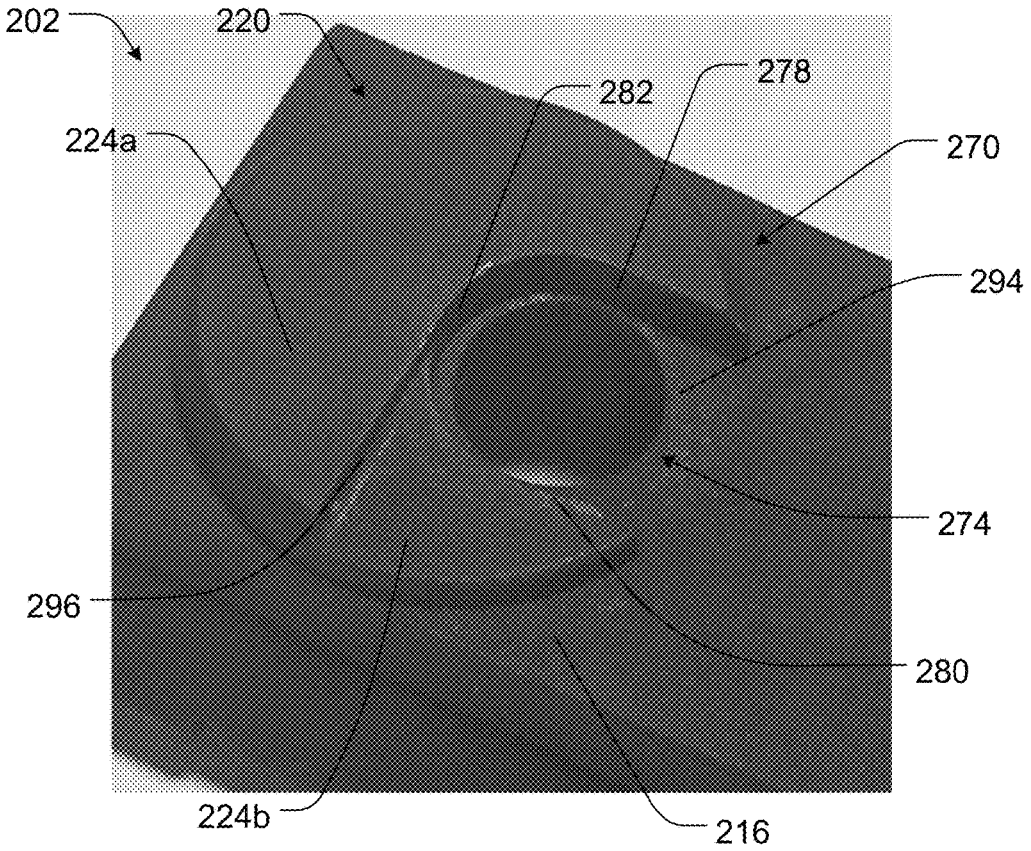
FIG. 19 is a close-up perspective view of a portion of the lower mounting surface of the rail section of FIG. 17.

Referring now to FIGS. 18 and 19, in order to make fastening of the rail segment body 204 to the tubular body 82 of the handguard 80 easier by holding and retaining the second fastener member 252 in its proper fastening position, the rail segment body 204 may cooperate with the fastener 240 to provide an anti-rotation locking mechanism 270.

As part of the anti-rotation/locking mechanism 270, the rail segment body 204, and more particularly each of the bosses 220 may include a fastener (second fastener member) receptacle 274 located in the confines thereof, which is keyed to receive second fastener member 252. As discussed is greater detail below, once the pillar portion 256 of the second fastener member 252 enters the receptacle 274, the second fastener member 252 may now be retained in the receptacle 274 and inhibited from rotating out of the receptacle 274.

As shown, the receptacle 274 is elongated and hence non-circular. As shown, the receptacle 274 more particularly has a U-shape, and have two opposing substantially parallel (e.g. within 5 degrees) planar sidewall sections 278, 280 on opposing sides of the receptacle 274, which are joined by a semi-circular wall 282. In the present embodiment, the bottom wall 294, or floor, of the receptacle 274 is coextensive (planar) with base surface 216. As shown, the sidewall sections 278, 280 are also substantially parallel with the center longitudinal axis $CLA_R$ of the rail segment body 204.

Similarly, referring now to FIGS. 12 and 13, with regards to fastener member 252, outer sidewall of the pillar portion 256 includes planar sidewall sections 290, 292 on opposing sides of the pillar portion 256 which may be referred to as flats. The lateral width of the pillar portion 256 between the planar sidewall sections 290, 292 may be substantially equal to a lateral width of the receptacle 274 between planar sidewall sections 278, 280. More particularly, the lateral width of the pillar portion 256 between the planar sidewall sections 290, 292 may be in a range of 0.001 inch to 0.01 inch less than the lateral width of the receptacle 274 between planar sidewall sections 278, 280 such that the pillar portion 256 may fit into the receptacle 274.

When the latch portion 260 of each second fastener member 252 (which is initially positioned to face longitudinally outwards) is rotated 180 degrees such that the latch portion 260 of each second fastener member 252 is positioned to face longitudinally inwards on the center longitudinal axis $CLA_R$ of the rail segment body 204 (i.e. the center longitudinal axis $CLA_L$ of the latch portion 260 is substantially parallel (aligned) with the longitudinal axis $CLA_R$ of the rail segment body 204, the planar sidewall sections 290, 292 of the pillar portion 256 of the second fastener 252 will come into parallel alignment with the planar sidewall sections 278, 280 of the receptacle 274, and the pillar portion 256 of the second fastener member 252 will enter and be seated in receptacle 274.

Once the second fastener member 252 is seated in the receptacle 274, the second fastener member 252 may now be inhibited from rotating out of the receptacle 274, particularly by the planar sidewall sections 290, 292 of the pillar portion 256 of the second fastener 252 making contact with planar sidewall sections 278, 280 of the receptacle 274 when such is rotated either clockwise or counter-clockwise. As such, it is now possible to further thread the first fastener member 272 into the second fastener member 252 without a need to hold the second fastener member 252 in proper orientation to inhibit it from rotating.

Referring once again to FIGS. 18 and 19, in order to better facilitate the rotation of the second fastener member 252 one-hundred-eighty (180) degrees from its initial position (i.e., the latch portion 260 of each second fastener member 252 being positioned to face longitudinally outwards to face longitudinally inwards), as well as assist the pillar portion 256 of the second fastener member 252 to properly seat in receptacle 274 of the rail segment body 204, a portion of the top surface 224 of each boss 220 may descend towards the base surface 216 (i.e. a portion of each boss 220 may be reduced in height or be shorter) such that the boss 220 has a varying height. As shown a portion of the top surface 224 descends from an upper portion 224*a* to a lower portion 224*b* and, more particularly steps down from upper portion 224*a* to lower portion 224*b* via a step 296. Moreover, as shown, the step down 296 occurs on a portion of the top surface 224 over which the latch portion 260 rotates in response to the first fastener member 242 rotating as a result of being turned in a thread tightening (clockwise) direction.

Moreover, referring once again to FIGS. 12 and 13, in order to further facilitate and ease the rotation of the second fastener member 252 from its initial position with latch portion 260 of each second fastener member 252 being positioned to face longitudinally outwards to face longitudinally inwards, as well as assist the pillar portion 256 of the second fastener member 252 to properly seat in receptacle 274 of the rail segment body 204, the width of the planar sidewall section 290 on one side of the pillar portion 256 may be narrower than the width of the planar sidewall section 292 on the opposing side of the pillar portion 256. As a result, the receptacle engagement edge 300 of planar sidewall section 290 (which provides a leading engagement edge into receptacle 274 of a leading engagement side of the second fastener member 252 with respect to rotation of the second fastener member 252 from the aperture insertion position to the mounting position) has a decreased length as compared to the receptacle engagement edge 302 of planar sidewall section 292 (which provides a trailing engagement edge of a trailing engagement side of the second fastener member 252 into receptacle 274 with respect to rotation of the second fastener member 252 from the aperture insertion position to the mounting position). The narrower width of the planar sidewall section 290 and corresponding shorter length of receptacle engagement edge 300 of planar sidewall section 290 enables the second fastener member 252 to enter receptacle 274 more easily than if the width of the planar sidewall section 290 was equal to the width of planar sidewall section 292, and the corresponding length of receptacle engagement edge 300 of planar sidewall section 290 was equal to the length of receptacle engagement edge 302 of planar sidewall section 292.

Furthermore, to further facilitate and ease the rotation of the second fastener member 252 from its initial position with latch portion 260 of each second fastener member 252 being positioned to face longitudinally outwards to face longitudinally inwards, the intermediate (transition) sidewall section 310 between planar sidewall section 290 and planar sidewall section 292 may be a continually curved section, with the curved section having an increasing radial distance from a center (rotational) axis of the second fastener member 252 as the section 310 transitions from the leading receptacle engagement edge 300 to the trailing receptacle engagement edge 302. Similarly, the corresponding receptacle engagement edge 312 of the intermediate (transition) sidewall section 310 between receptacle engagement edges 300, 302 of sidewall sections 290, 292, respectively, may be a continually curved edge, with the curved edge having an increasing radial distance from the center (rotational) axis of the second fastener member 252 as the section 310 transitions from the leading edge 300 to the trailing edge 302.

Figure 20:
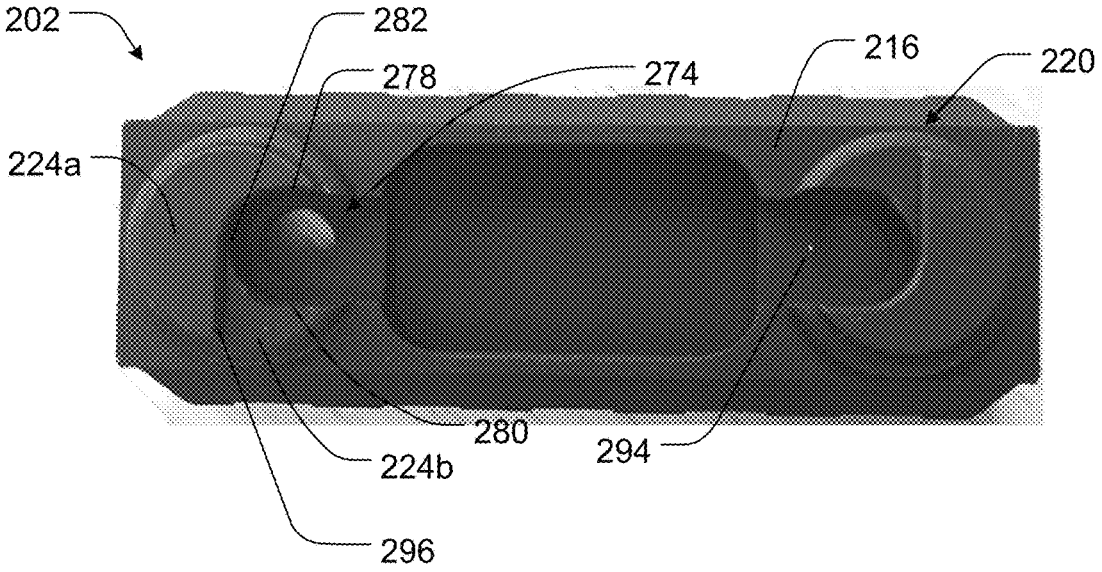
FIG. 20 is a close-up bottom view of the lower mounting surface another rail section according to the present disclosure.

Referring now to FIG. 20, as shown the bottom wall 294 of the receptacle 274 is no longer planar with base surface 216, but rather recessed relative to base surface 216, particularly to increase the length of the sidewalls 278, 280, 282 and the depth of the receptacle 274.

While embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

LIST OF REFERENCE CHARACTERS

10 firearm
12 receiver
14 lower receiver
16 upper receiver
18 magazine receptacle
30 bolt carrier
40 barrel
50 butt stock
60 pistol grip
80 handguard
82 tubular body
84 center passage
86 tubular body outer surface
88 tubular body inner surface
89 inner profile
90 apertures
92 top side of handguard
94 accessory rail
96 rail ribs
98 rail slots
100 rail reinforcement structure
102 reinforcement layer
104 reinforcement layer
106 reinforcement layer
108 reinforcement layer
110 matrix composition
150 attachment member
152 outer profile
200 rail segment assembly
202 rail segment
204 rail segment body
206 lower (mounting) surface
208 upper (outer) surface
210 longitudinal ends
212 ribs
214 slots
216 base surface
220 boss
224 boss top surface
224*a* upper portion of top surface
224*b* lower portion of top surface
226 boss side surface
228 fillet
230 through-hole
240 fastener
242 first fastener member
252 second fastener member
256 pillar portion
260 clamping latch portion
270 anti-rotation/locking mechanism
274 receptacle
278 planar sidewall section of receptacle
280 planar sidewall section of receptacle
282 semi-circular wall
290 planar sidewall sections of barrel portion
292 planar sidewall sections of barrel portion
294 bottom wall of receptacle
296 step
300 leading engagement edge
302 training engagement edge
310 transition sidewall section of barrel portion
312 transition engagement edge
$C_B$ center of boss
$C_{TH}$ center of through-hole
$CLA_L$ center longitudinal axis of latch
$CLA_R$ center longitudinal axis of rail segment body
$CRA_F$ center rotational axis of fastener
$LD_A$ Center-to-center longitudinal distance between apertures
$LD_B$ Center-to-center longitudinal distance between bosses
$LD_{TH}$ Center-to-center longitudinal distance between through-holes
$OD_B$ outside diameter of boss
LA longitudinal axis

What is claimed is:

1. A handguard assembly for a firearm comprising:
a handguard configured to overlie a barrel of the firearm in spaced relationship, the handguard comprising a plurality of apertures;
a rail segment including a plurality of mounting bosses, each of the plurality of mounting bosses located in a different one of the plurality of apertures of the handguard;
a plurality of rotatable fasteners to fasten the rail segment to the handguard, each of the rotatable fasteners located in a different one of the mounting bosses of the rail segment;
each of the rotatable fasteners comprising a mounting latch to mount the rail segment to the handguard, each mounting latch rotatable from an aperture insertion position overlying a top of the boss to a mounting position overlying the handguard;
at least one of the mounting bosses includes a fastener receptacle, the fastener receptacle comprising a recess formed in the at least one mounting boss;
at least a portion of the rotatable fastener located in the recess of the fastener receptacle when the mounting latch is in the mounting position; and
the rotatable fastener and the recess of the fastener receptacle cooperate to mechanically inhibit the mounting latch of the rotatable fastener from rotating when the mounting latch is in the mounting position.

2. The handguard assembly of claim 1 wherein:
the rotatable fastener located in the recess of the fastener receptacle comprises a first fastener member and a second fastener member; and
the second fastener member provides the mounting latch.

3. The handguard assembly of claim 2 wherein:
the first fastener member and the second fastener member are mechanically connected by threaded engagement.

4. The handguard assembly of claim 3 wherein:
the first fastener member comprises an externally threaded fastener member; and
the second fastener member comprises an internally threaded fastener member.

5. The handguard assembly of claim 4 wherein:
the first fastener member comprises a screw; and
the second fastener member comprises a nut having a pillar and the mounting latch.

6. The handguard assembly of claim 2 wherein:
the second fastener member and the recess of the fastener receptacle cooperate to mechanically inhibit the mounting latch of the second fastener member from rotating when the mounting latch is in the mounting position without inhibiting the first fastener member from rotating with respect to the second fastener member.

7. The handguard assembly of claim 6 wherein:

the first fastener member is rotatable in a first direction to tighten the mounting latch of the second fastener to the handguard, and rotatable in a second direction opposite the first direction to loosen the mounting latch of the second fastener from the handguard.

8. The handguard assembly of claim 1 wherein:

the at least one mounting bosses which includes the fastener receptacle has a boss height; and when the mounting latch of the rotatable fastener located in the at least one mounting boss which includes the fastener receptacle is rotated from the aperture insertion position overlying a top of the boss to the mounting position overlying the handguard, the boss height decreases transverse to the direction of rotation of the mounting latch.

9. The handguard assembly of claim 1 wherein:

the at least one mounting boss which includes the fastener receptacle has a top surface; and the top surface is stepped.

10. The handguard assembly of claim 1 wherein:

the at least one mounting boss which includes the fastener receptacle has a top surface; and when the mounting latch of the rotatable fastener located in the at least one mounting boss which includes the fastener receptacle is rotated from the aperture insertion position overlying a top of the boss to the mounting position overlying the handguard, the top surface steps down transverse to the direction of rotation of the mounting latch.

11. The handguard assembly of claim 2 wherein:

the second fastener member has a leading receptacle engagement edge and a trailing receptacle engagement edge located in the fastener receptacle, wherein the leading receptacle engagement edge and the trailing receptacle engagement are located on opposing sides of the second fastener member; and when the mounting latch of the rotatable fastener located in the at least one mounting boss which includes the fastener receptacle is rotated from the aperture insertion position overlying a top of the boss to the mounting position overlying the handguard, the leading receptacle engagement edge leads the second fastener member into the fastener receptacle; and wherein the leading receptacle engagement edge has a shorter length than the trailing receptacle engagement edge.

12. The handguard assembly of claim 11 wherein:

the leading receptacle engagement edge and the trailing receptacle engagement are located on opposing sides of a pillar of the second fastener member.

13. The handguard assembly of claim 11 wherein:

the leading receptacle engagement edge is an edge of a planer surface located on a leading receptacle engagement side of the second fastener member; and the trailing receptacle engagement edge is an edge of a planar surface located in a trailing receptacle engagement side of the second fastener member.

14. The handguard assembly of claim 11 wherein:

an intermediate receptacle engagement edge is disposed between the leading receptacle engagement edge and the trailing receptacle engagement; and wherein the intermediate receptacle engagement edge is a continually curved edge.

15. The handguard assembly of claim 11 wherein:

the second fastener member is rotatable about an axis of rotation;

the continually curved edge is defined by a radius about the axis of rotation, wherein the radius has a length; and the length of the radius increases continuously along the continually curved edge from the leading receptacle engagement edge to the trailing receptacle engagement.

16. A handguard assembly for a firearm comprising:

a handguard configured to overlie a barrel of the firearm in spaced relationship, the handguard comprising a plurality of apertures;

a rail segment including a plurality of mounting bosses, each of the plurality of mounting bosses located in a different one of the plurality of apertures of the handguard;

a plurality of rotatable fasteners to fasten the rail segment to the handguard, each of the rotatable fasteners located in a different one of the mounting bosses of the rail segment;

each of the rotatable fasteners comprising a mounting latch arrangeable in a mounting position to mount the rail segment to a handguard of the firearm;

at least one of the mounting bosses includes a fastener receptacle, the fastener receptacle comprising a recess formed in the at least one mounting boss;

at least a portion of the rotatable fastener located in the recess of the fastener receptacle; and the rotatable fastener and the recess of the fastener receptacle cooperate to mechanically inhibit the mounting latch of the rotatable fastener from rotating when the mounting latch is in the mounting position.

17. A rail segment assembly for a firearm comprising:

a rail segment including a plurality of mounting bosses;

a plurality of rotatable fasteners, each of the rotatable fasteners locatable in a different one of the mounting bosses of the rail segment;

each of the rotatable fasteners comprising a mounting latch arrangeable in a mounting position to mount the rail segment to a handguard of the firearm;

at least one of the mounting bosses includes a fastener receptacle, the fastener receptacle comprising a recess formed in the at least one mounting boss;

at least a portion of the rotatable fastener locatable in the recess of the fastener receptacle; and the rotatable fastener and the recess of the fastener receptacle cooperate to mechanically inhibit the mounting latch of the rotatable fastener from rotating when the mounting latch is in the mounting position.

* * * * *